US006189400B1

(12) United States Patent
Nakagome et al.

(10) Patent No.: US 6,189,400 B1
(45) Date of Patent: Feb. 20, 2001

(54) LID OPENER

(75) Inventors: Katsumi Nakagome; Yasuyuki Fukushima, both of Yokohama (JP)

(73) Assignee: Ohi Seisakusho Co., Ltd., Yokohama (JP)

( * ) Notice: Under 35 U.S.C. 154(b), the term of this patent shall be extended for 0 days.

(21) Appl. No.: 09/282,151

(22) Filed: Mar. 31, 1999

(30) Foreign Application Priority Data

Mar. 31, 1998 (JP) ..... 10-087235

(51) Int. Cl.[7] ..... G05G 1/00
(52) U.S. Cl. ..... 74/469; 292/336.3; 292/216
(58) Field of Search ..... 292/336.3, 201, 292/216, DIG. 138, 43; 74/469, 471 R, 470, 491, 519, 523, 526

(56) References Cited

U.S. PATENT DOCUMENTS 4,917,424 * 4/1990 Ishihara et al. ..... 292/336.3

FOREIGN PATENT DOCUMENTS 2330621 4/1999 (GB) .

09032386 * 2/1997 (JP) ..... 292/336.3

* cited by examiner

*Primary Examiner*—Charles A Marmor
*Assistant Examiner*—Tisha D. Waddell
(74) *Attorney, Agent, or Firm*—Foley & Lardner

(57) ABSTRACT

A lid opener for use in a vehicle comprises a base member secured to a vehicle body. A control lever is pivotally connected to the base member. A rear portion of the control lever is connected through a wire to a latch mechanism of a lid member. The control lever is capable of canceling a latched condition of the latch mechanism when pivoted in a normal direction from a rest position to a work position. A spring is used for biasing the control lever to assume the rest position. A first stopper structure includes the rear portion of the control lever and a part of the base member. The rear portion is kept in contact with the part of the base member when the control lever assumes the rest position. A second stopper structure includes a part of the control lever and a stopper member which is defined by either one of the vehicle floor and the base member. The part of the control lever is brought into abutment with the stopper member when, upon receiving a marked stress, the control lever is pivoted from the rest position in a direction opposite to the normal direction.

12 Claims, 10 Drawing Sheets

LID OPENER

BACKGROUND OF THE INVENTION

1. Field of the Invention

The present invention relates in general to lid openers for use in motor vehicles for remotely controlling or unlatching a lid, such as a filler cap, a trunk lid or the like. More specifically, the present invention relates to the lid openers of a double lever type having two control levers for remotely controlling or unlatching two lid members respectively.

2. Description of the Prior Art

In order to clarify the task of the present invention, one conventional lid opener will be briefly described with reference to FIGS. 10 and 11 of the accompanying drawings.

As is seen from FIG. 10, the lid opener 100 shown is of a double lever type. The lid opener 100 is arranged on a vehicle floor "F", more specifically, on a base member 102 tightly held by a cross member 104 of the vehicle body.

The lid opener 100 comprises two, viz., longer and shorter control levers 106 and 108 which are pivotally disposed about a common shaft 110 held by the base member 102. The two control levers 106 and 108 have rear ends 106*a* and 108*a* from which respective wires 112 (114) extend to respective latch mechanisms of a trunk lid and a filler cap. The two control levers 106 and 108 are biased to assume horizontal rest positions by respective biasing springs 116 and 118. When the longer control lever 106 is pulled up against the biasing force of the spring 116, the wire 112 is driven in a direction to cancel a latched condition of the latch mechanism of the trunk lid. Upon this, the trunk lid becomes unlatched and thus can be opened. While, when the shorter control lever 108 is pulled up against the force of the spring 118, the wire 114 is pulled to unlatch the filler cap.

For ease with which the two control levers 106 and 108 are manipulated by a driver, such lid opener 100 is arranged just beside the driver's seat, that is, in a limited space defined between the driver's seat and the driver's door.

However, due to inherency originating from the position where the lid opener 100 is located, it often happens that the lid opener 100 is strongly stepped on by the driver at his or her ingress and egress into and from the vehicle cabin, which tends to cause damages of the control levers 106 and 108.

For eliminating such drawbacks, various measures have been hitherto proposed, which are, for example, covering the lid opener 100 with a cover member, using a much thicker metal plate as the material of the control levers 106 and 108, locating the lid opener 100 away from such limited space, etc.,. However, even these measures have failed to provide users with satisfaction. In fact, such measures tend to induce a bulky, costly and/or ill-handy lid opener.

SUMMARY OF THE INVENTION

It is therefore an object of the present invention to provide a lid opener which is free of the above-mentioned drawbacks.

According to the present invention, there is provided a lid opener which is so constructed that when a marked stress is applied to a control lever of the lid opener due to accidental stepping by a passenger, the control lever becomes supported by at least three supporting points thereby minimizing the force actually applied to each point. Thus, undesired deformation and damage of the control lever is suppressed.

According to a first aspect of the present invention, there is provided a lid opener for use in a vehicle having a body and a floor. The lid opener comprises a base member adapted to be secured to the body; a control lever pivotally connected to the base member, the control lever including front and rear portions which are defined with respect to the pivoted portion, the rear portion being connected through a power transmitting member to a latch mechanism of a lid member, the control lever being capable of canceling a latched condition of the latch mechanism when pivoted in a normal direction from a rest position to a work position; biasing means for biasing the control lever to assume the rest position; a first stopper structure including the rear portion of the control lever and a part of the base member, the rear portion being kept in contact with the part of the base member when the control lever assumes the rest position; and a second stopper structure including a part of the control lever and a stopper member which is defined by either one of the vehicle floor and the base member, the part of the control lever being brought into abutment with the stopper member when, upon receiving a marked stress, the control lever is pivoted from the rest position in a direction opposite to the normal direction.

According to a second aspect of the present invention, there is provided a lid opener unit for use in a vehicle. The vehicle has a hollow cross member mounted on a vehicle floor, and the hollow cross member has in a wall thereof an opening. The lid opener unit includes a base member installed in and secured to the hollow cross member near the opening; a control lever pivotally connected to the base member, the control lever including front and rear portions which are defined with respect to the pivoted portion, the front portion being exposed to the outside through the opening, the rear portion being connected through a power transmitting member to a latch mechanism of a lid member, the control lever being capable of canceling a latched condition of the latch mechanism when pivoted in a normal direction from a rest position to a work position; biasing means for biasing the control lever in a direction to assume the rest position; a first stopper structure including the rear portion of the control lever and a part of the base member, the rear portion being kept in contact with the part of the base member when the control lever assumes the rest position; and a second stopper structure including a part of the control lever and a stopper member which is defined by either one of the vehicle floor and the base member, the part of the control lever being brought into abutment with the stopper member when, upon receiving a marked stress, the control lever is pivoted from the rest position in a direction opposite to the normal direction.

BRIEF DESCRIPTION OF THE DRAWINGS

Other objects and advantages of the present invention will become apparent the following description when taken in conjunction with the accompanying drawings, in which.

DETAILED DESCRIPTION OF THE EMBODIMENTS

Referring to FIGS. 1 to 5, there is shown a double lever type lid opener 100A which is a first embodiment of the present invention.

Figure 1:
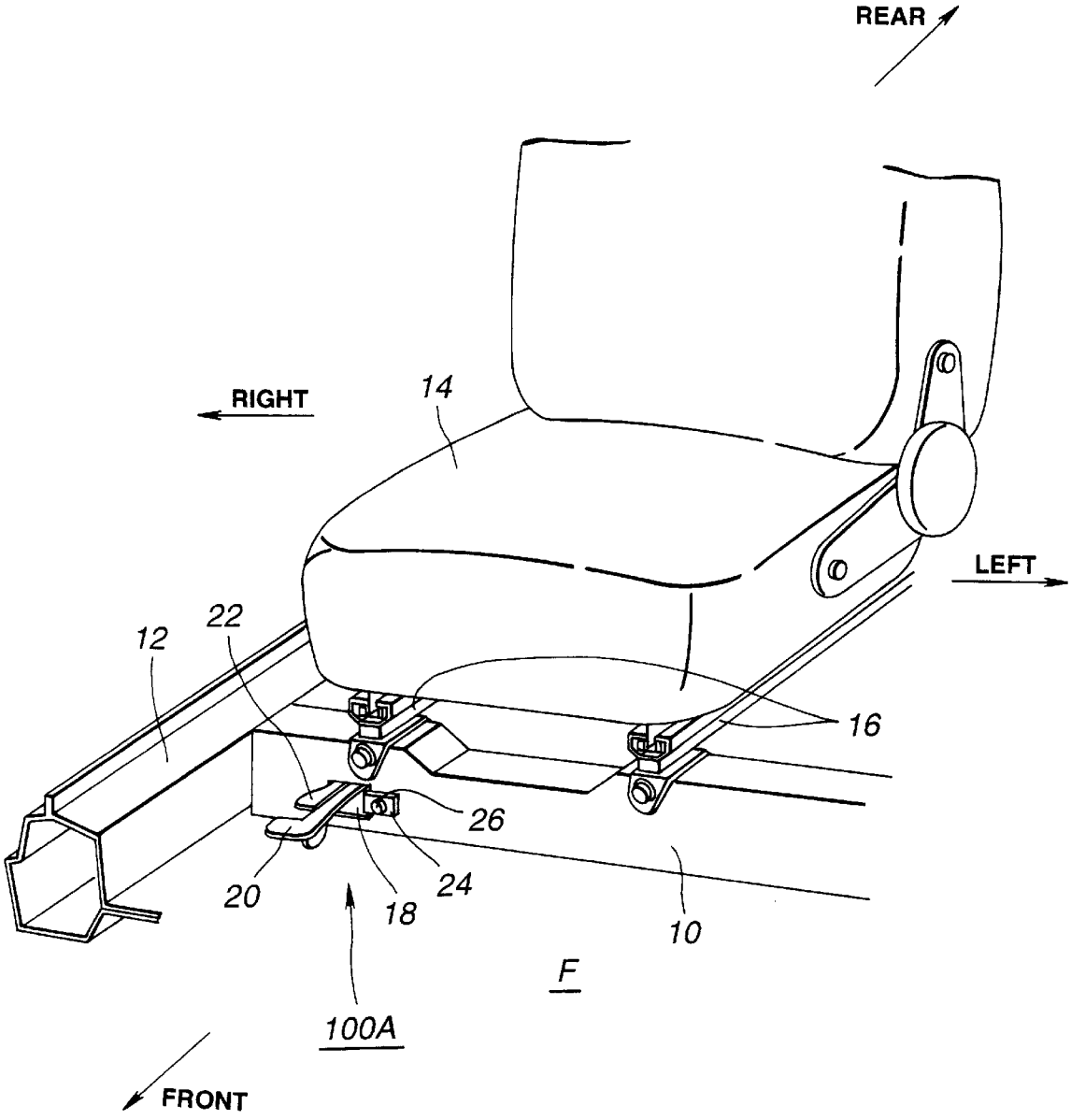
FIG. 1 is a view of the interior of a vehicle cabin, showing a double lever type lid opener of a first embodiment of the present invention.

As is seen from FIG. 1, a major section of the lid opener 100A is installed in a hollow cross member 10 of a vehicle body at a position between a side sill 12 and a driver's seat 14.

In the following, directional terms, such as "right", "left", "front", "rear", "rightward", "leftward", "forward", "rearward" and the like are to be understood with respect to the driver sitting on the seat 14.

Although not shown in the drawing, a front right door (viz., driver's door) is arranged on the side sill 12, which closes and opens a door opening defined above the side sill 12. In the illustrated embodiment, a front portion of the driver's seat 14 is disposed on the cross member 10 through a pair of seat sliders 16. Denoted by reference "F" is a floor of the vehicle.

The hollow cross member 10 is formed at its front wall with a rectangular opening 18 through which front portions of the control levers 20 and 22 are projected forwardly. Thus, a driver sitting on the seat 14 can easily handle the control levers 20 and 22 only by extending down his or her right hand toward the levers 20 and 22. Denoted by numeral 24 is a base member of the lid opener 10A, which is secured via a bolt 26 to the cross member 10 for supporting essential parts of the double lever type lid opener 100A.

Figure 2:
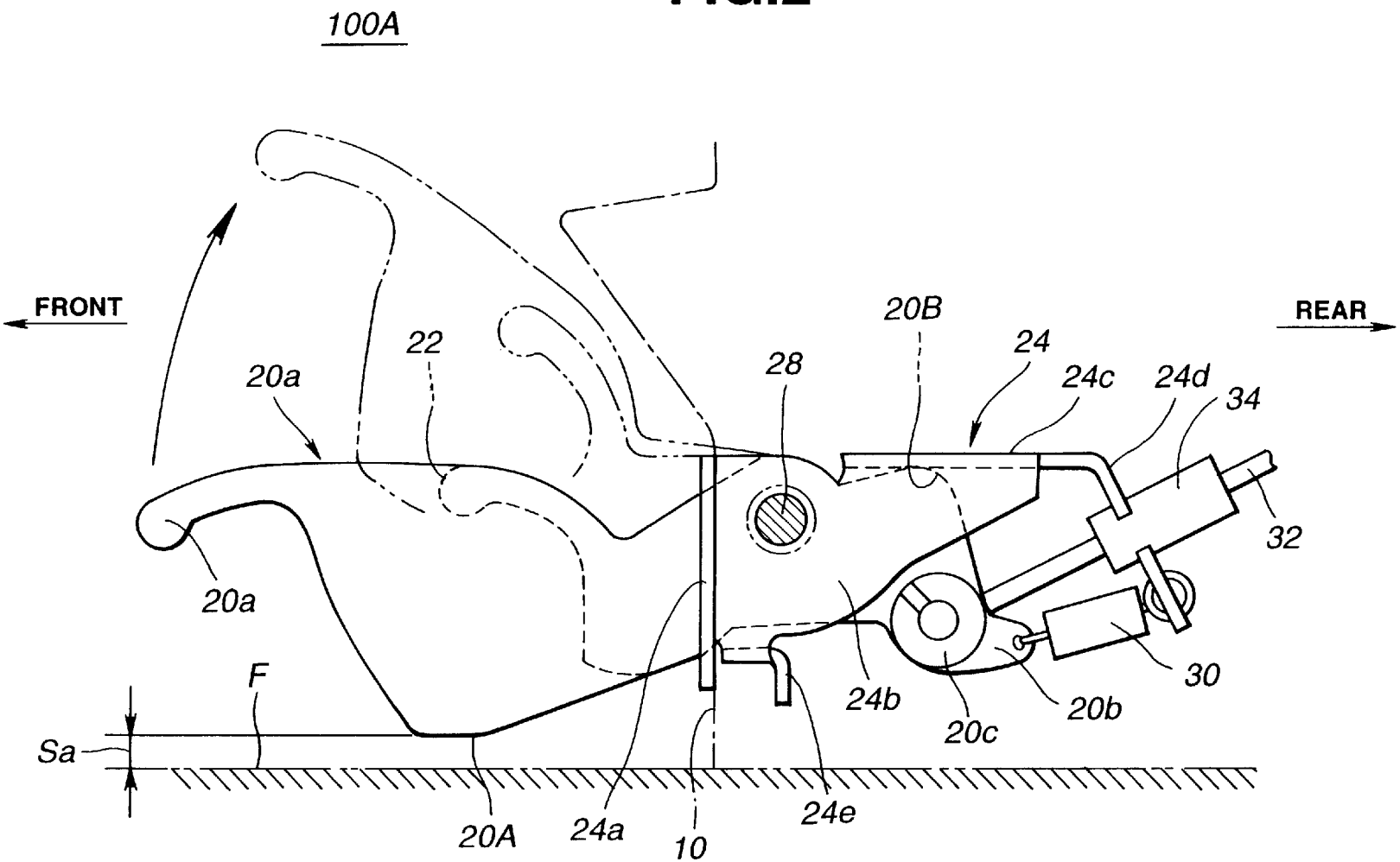
FIG. 2 is a front view of the double lever type lid opener of the first embodiment.
Figure 3:
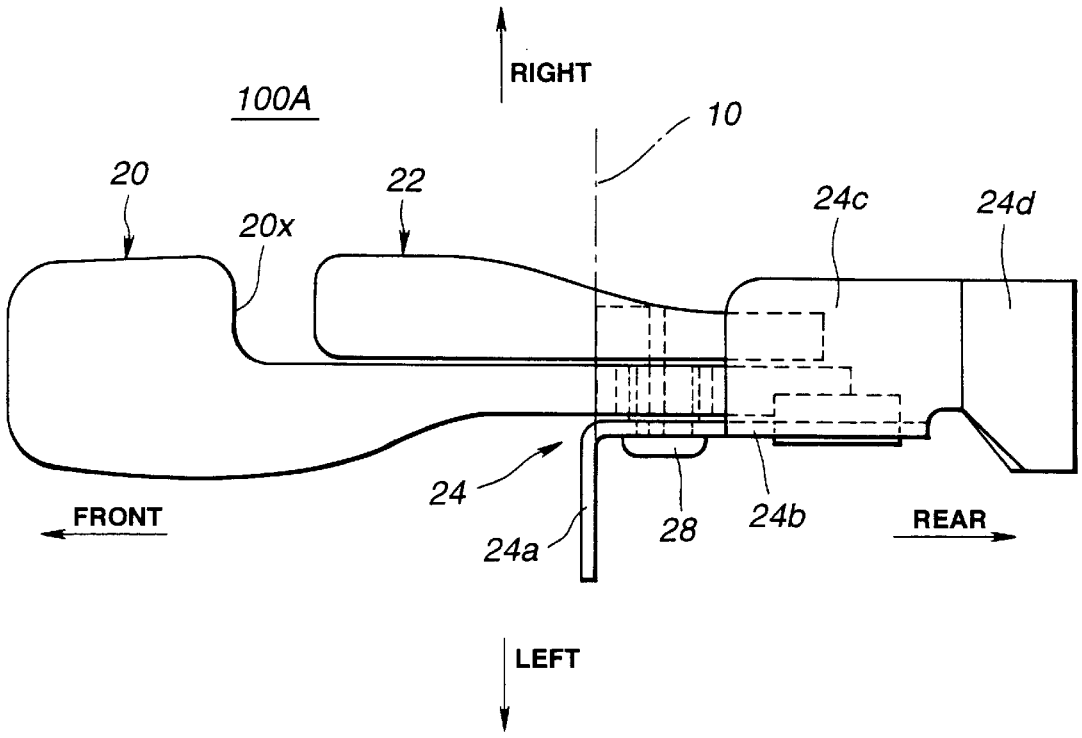
FIG. 3 is a plan view of the double lever type lid opener of the first embodiment.
Figure 4:
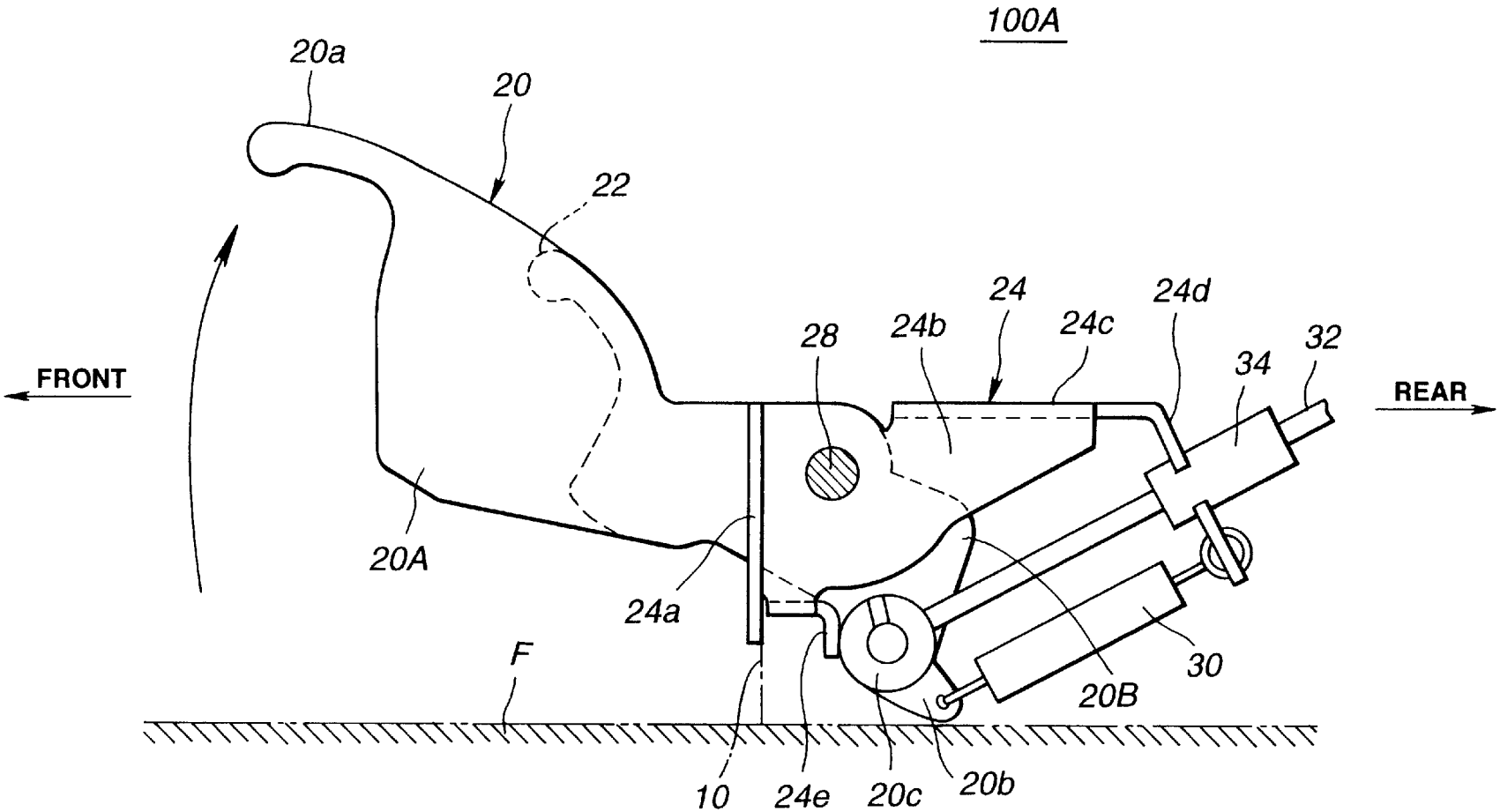
FIG. 4 is view similar to FIG. 2, but showing a condition wherein control levers are pulled up.

As is seen from FIGS. 2 and 3, the lid opener 100A comprises two, viz., longer and shorter control levers 20 and 22 which are pivotally disposed about a common pivot shaft 28 which is held by the base member 24. The levers 20 and 22 and the base member 24 are constructed of reinforced plastics, such as reinforced polyacetal resin or the like. However, if desired, these members 20, 22 and 24 may be constructed of metals. For increased strength, each lever 20 or 22 is shaped to have a generally L-shaped cross section. Furthermore, each lever 20 or 22 has at the front exposed part a convexly curved upper edge (no numeral).

The base member 24 comprises a front flat part 24*a* bolted to the front wall of the cross member 10, a middle flat part 24*b* extending rearward from the front flat part 24*a*, an upper cover part 24*c* extending laterally from an upper end of the middle flat part 24*b* and an inclined rear part 24*d*. The common shaft 28 is held by the middle flat part 24*b*. The middle flat part 24*b* is formed at its lower portion with a stopper projection 24*e* which extends rightward in FIG. 1, that is, toward the shorter control lever 22. The shape of the stopper projection 24*e* may be imaged from the drawing of FIG. 8.

As is seen from FIG. 3, the longer control lever 20 has a recess 20*x* in which the shorter control lever 22 is snugly received.

As is seen from FIG. 2, the longer control lever 20 has at a front end a thinner grip portion 20*a* which is shaped to be easily gripped by an operator (viz., driver). A rear end 20*b* of the longer control lever 20 is connected to the inclined rear part 24*d* of the base member 24 through a biasing spring 30. Due the force of this spring 30, the longer control lever 20 is biased to assume its horizontal rest position as illustrated by a solid line in FIG. 2. A wire connector 20*c* is provided on the rear end 20*b* of the control lever 20, which holds one end of a wire 32 extending from a latch mechanism of a trunk lid. A guide member 34 is pivotally held by the inclined rear part 24*d* of the base member 24, through which the wire 32 passes. When thus the longer control lever 20 is pulled up against the force of the biasing spring 30, the wire 32 is driven in a direction to cancel a latched condition of the latch mechanism of the trunk lid. Upon this, the trunk lid becomes unlatched and thus can be opened. As will be described in detail hereinafter, when the longer control lever 20 is pulled up to its uppermost position as illustrated by a phantom line in FIG. 2, the wire connector 20*c* of the lever 20 abuts against the stopper projection 24*e* of the base member 24. That is, the stopper projection 24*e* functions to suppress excessive upward pivoting of the longer control lever 20.

It is now to be noted that the shorter control lever 22 has substantially the same construction as the above-mentioned longer control lever 20 except that in the shorter control lever 22, a wire connected to the rear end of the lever 22 extends to a latch mechanism of a filler cap. That is, when the shorter control lever 22 is pulled up against the force of a corresponding biasing spring, the latch mechanism of the filler cap becomes unlatched ant thus the filler cap can be opened. Also in this case, the stopper projection 24*e* functions to suppress excessive upward pivoting of the shorter control lever 22.

In the first embodiment 100A, the following measures are further employed.

That is, as is seen from FIG. 2, front and rear stopper portions 20A and 20B are defined at front and rear portions of the control lever 20. The front stopper portion 20A is constituted by a downwardly protruded part of the front portion of the lever 20, and the rear stopper portion 20B is constituted by an upwardly protruded part of the rear portion of the lever 20. That is, when the longer control lever 20 assumes the horizontal rest position as shown in FIG. 2, the rear stopper portion 20B abuts against the upper cover part 24*c* of the base member 24 leaving a predetermined space "Sa" between the front stopper portion 20A and the vehicle floor "F".

It is to be noted that the thickness of the space "Sa" is determined smaller than a moved distance which is exhibited by the front stopper portion 20A when the latter is subjected to a maximum resilient deformation, that is, when the lever 20 is strongly stepped by a passenger (viz., driver). Preferably, the thickness of the space "Sa" is smaller than about 5 mm.

It is to be noted that the above-mentioned measures of the longer control lever 20 are not needed by the shorter control lever 22. However, if desired, such measures may be applied to the shorter one.

In the following, operation will be described with the aid of the drawings.

For ease of understanding, the description will be commenced with respect to a rest condition of the lid opener 100A wherein both the longer and shorter control levers 20 and 22 assume their horizontal rest positions, as is seen from FIG. 2.

When the longer control lever 20 is pulled up against the force of the spring 30, the wire 32 is driven in a direction to cancel the latched condition of the latch mechanism of the trunk lid. Thus, the trunk lid becomes unlatched and thus can be opened. As is mentioned hereinabove, due to provision of the stopper projection 24*e* against which the wire connector 20*c* of the lever 20 can abut, the upper work position of the longer control lever 20 is assured. When then the longer control lever 20 is released, the lever 20 is returned to the horizontal rest position of FIG. 2 due to the force of the spring 30.

When the shorter control lever 22 is pulled up, the latched condition of the filler cap becomes canceled and thus the filler cap can be opened, like in the case of the above-mentioned trunk lid.

Figure 5:
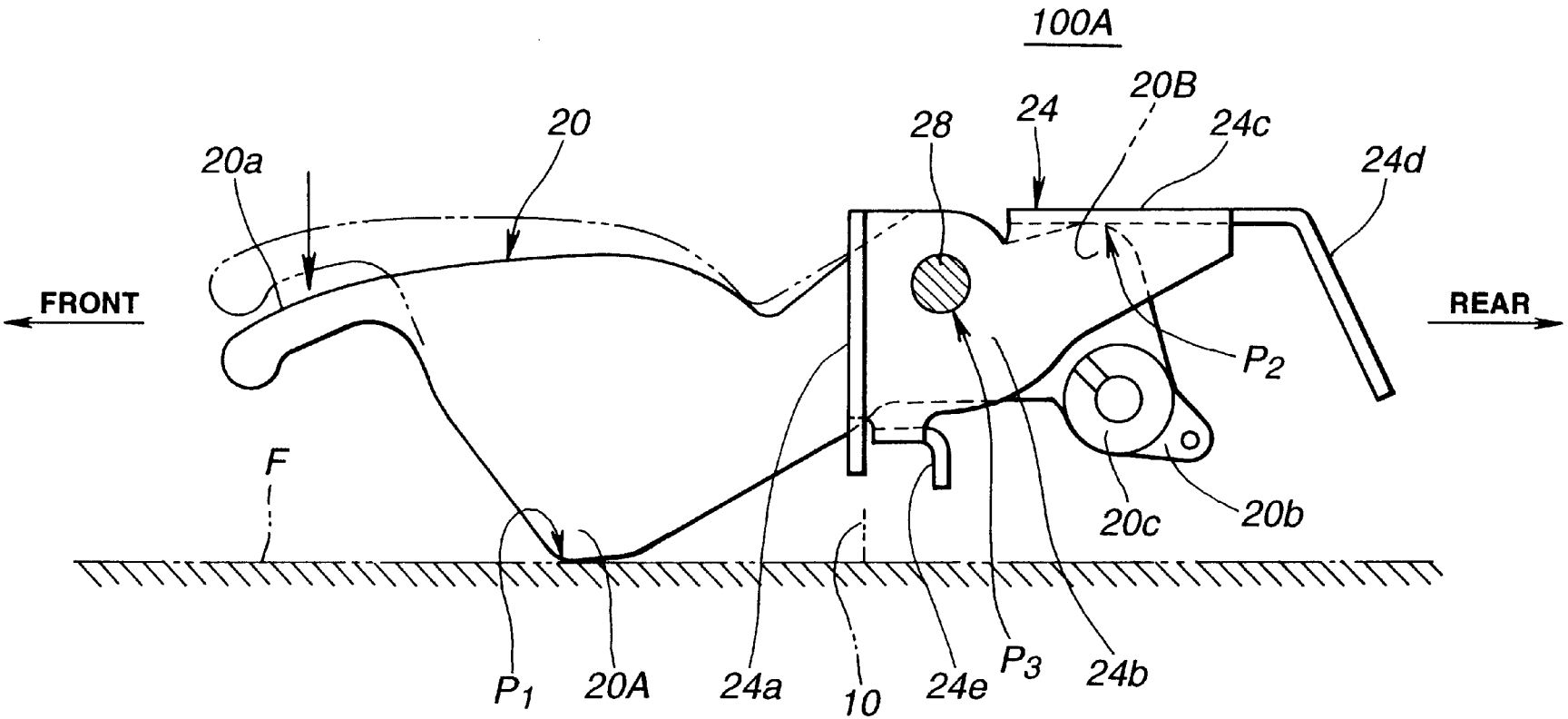
FIG. 5 is a view similar to FIG. 2, but showing a condition wherein the control levers are trampled.

When, with the lid opener 100A assuming the rest condition, a remarkable force "P" is suddenly applied to the exposed front portions of the longer and shorter control levers 20 and 22 due to accidental stepping by a driver's shoe as is seen from FIG. 5, the longer control lever 20 is pressed down bringing the front stopper portion 20A thereof into abutment with the vehicle floor "F" while keeping the abutment of the rear stopper portion 20B with the upper cover part 24*c* of the base member 24. During this, the longer control lever 20 is subjected to a resilient deformation by a degree of the thickness of the space "Sa", and upon abutment of the front stopper portion 20A with the vehicle floor "F", the force "P" applied to the longer control lever 20 becomes supported by three supporting points, which are a first supporting point "P1" where the front stopper portion 20A contacts the vehicle floor "F", a second supporting point "P2" where the rear stopper portion 20B contacts the upper cover part 24*c* of the base member 24 and a third supporting point "P3" where the longer control lever 20 is disposed about the pivot shaft 28. That is, the shock "P" applied to the longer control lever 20 is supported by the three points minimizing the force actually applied to each supporting point "P1", "P2" or "P3". Thus, undesired deformation and damage of the longer control lever 20 are suppressed.

It is to be noted that when both the longer and shorter control levers 20 and 22 are stepped by the driver's shoe, the longer control lever 20 protects the shorter control lever 22 by carrying out the above-mentioned self-supporting function.

Referring to FIGS. 6 to 9, there is shown a double lever type lid opener 100B which is a second embodiment of the present invention.

The lid opener 100B of this embodiment is similar to that of the above-mentioned first embodiment 100A. Thus, detailed explanation will be directed to only parts or portions which are different from those of the first embodiment 100A.

Figure 6:
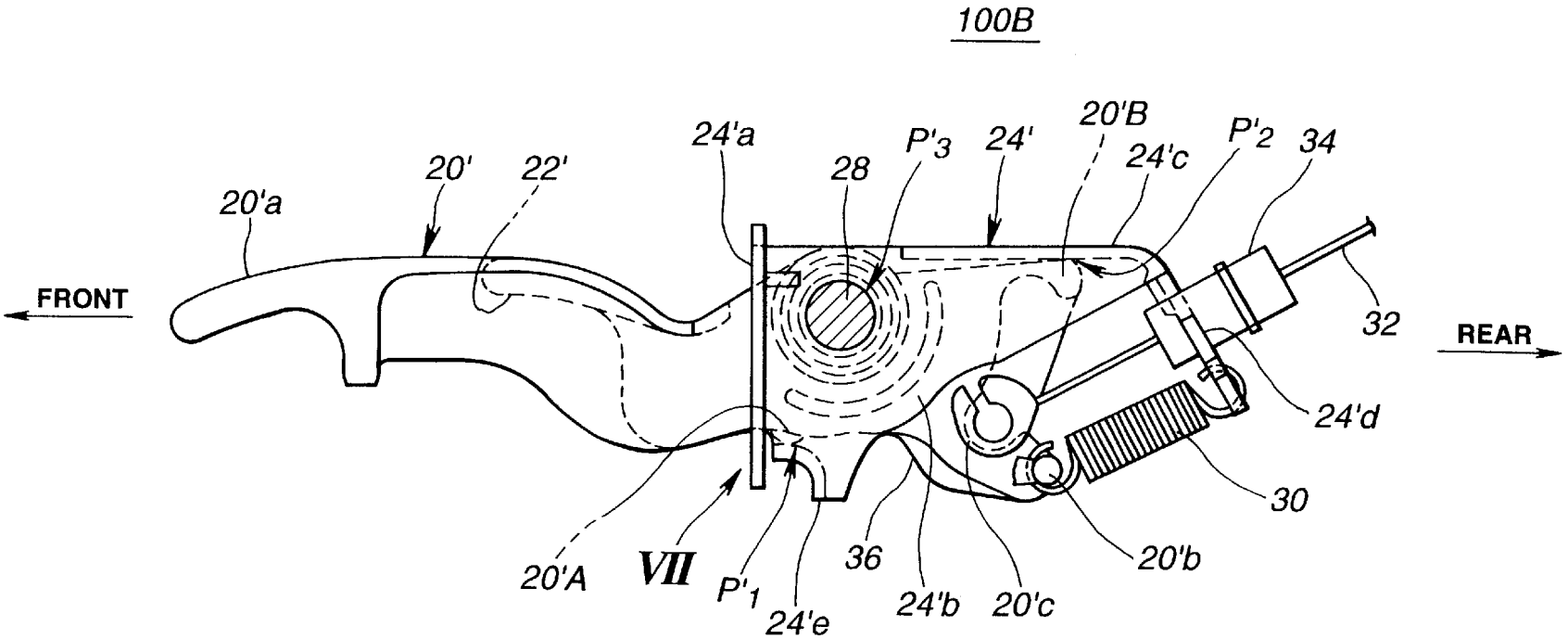
FIG. 6 is a front view of a double lever type lid opener which is a second embodiment of the present invention.
Figure 8:
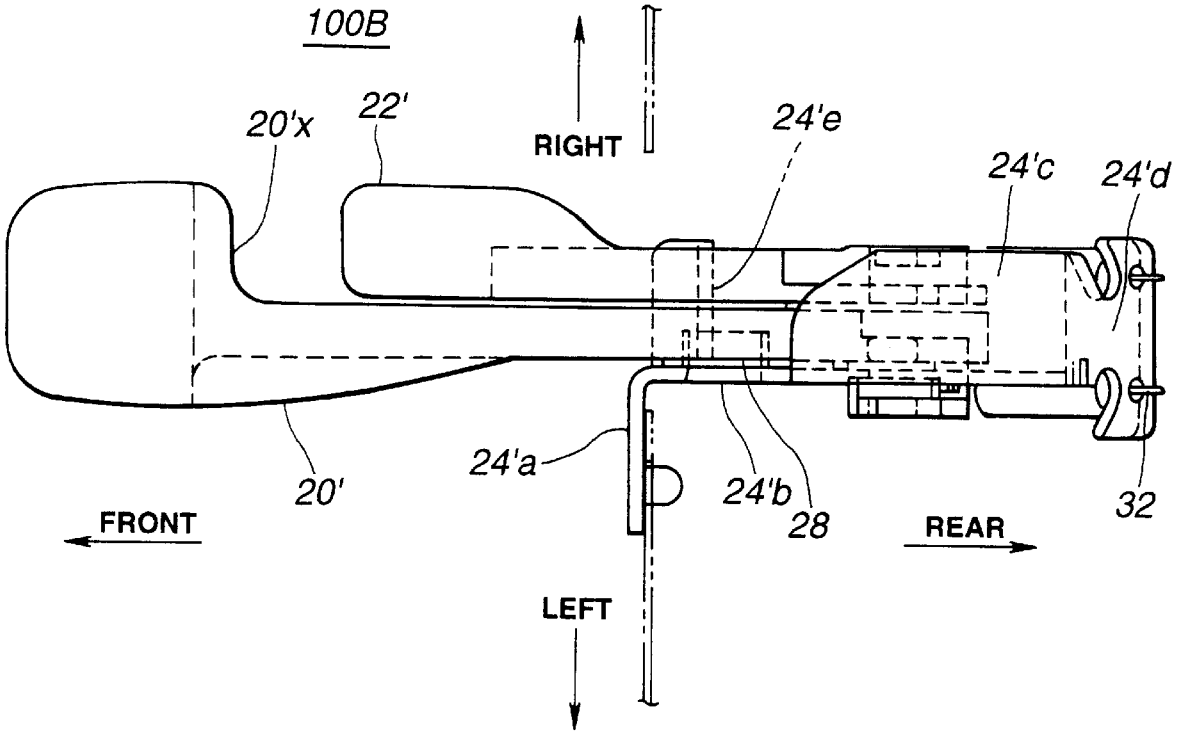
FIG. 8 is a plan view of the double lever type lid opener of the second embodiment.
Figure 9:
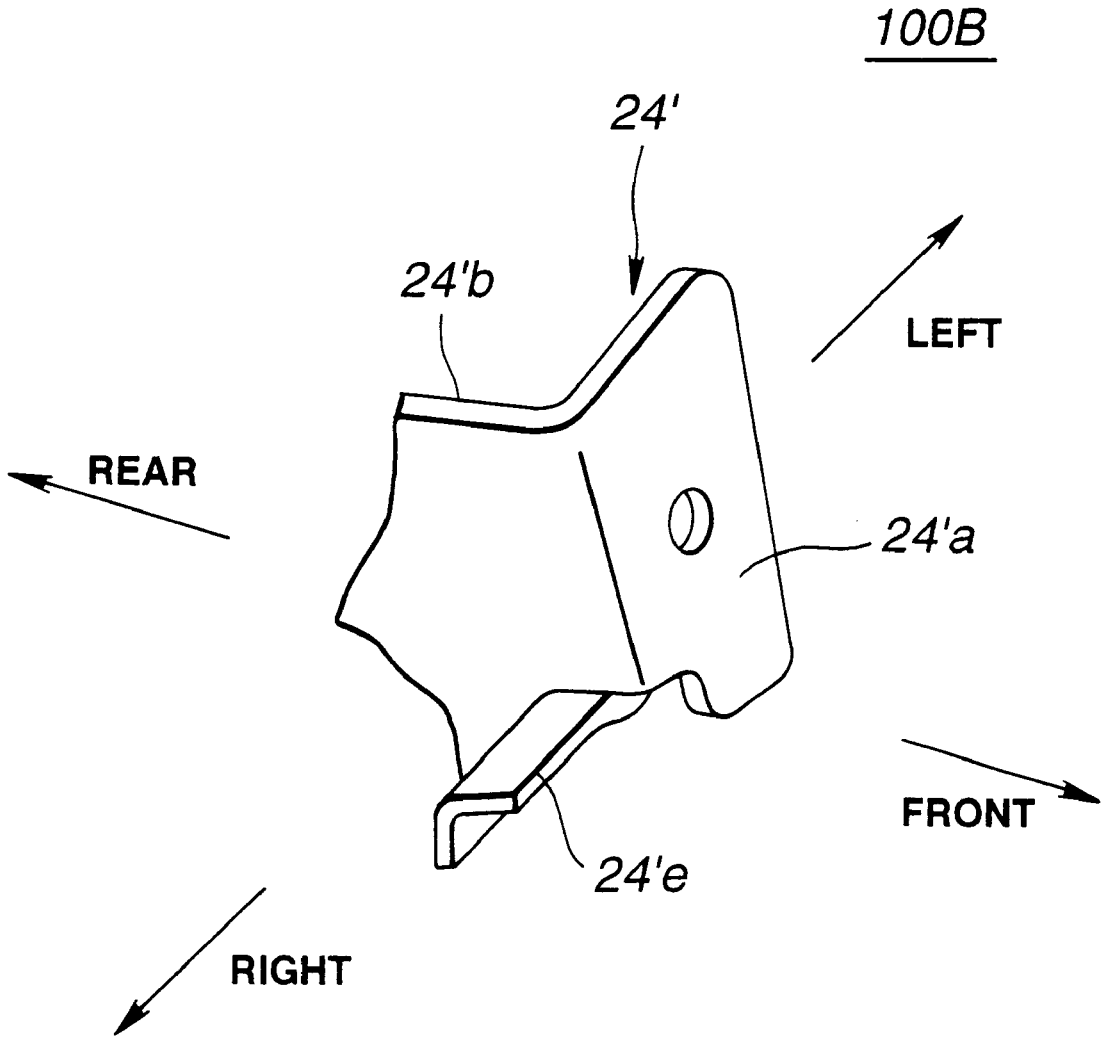
FIG. 9 is a partial and enlarged perspective view of a base member employed in the lid opener of the second embodiment.
Figure 10:
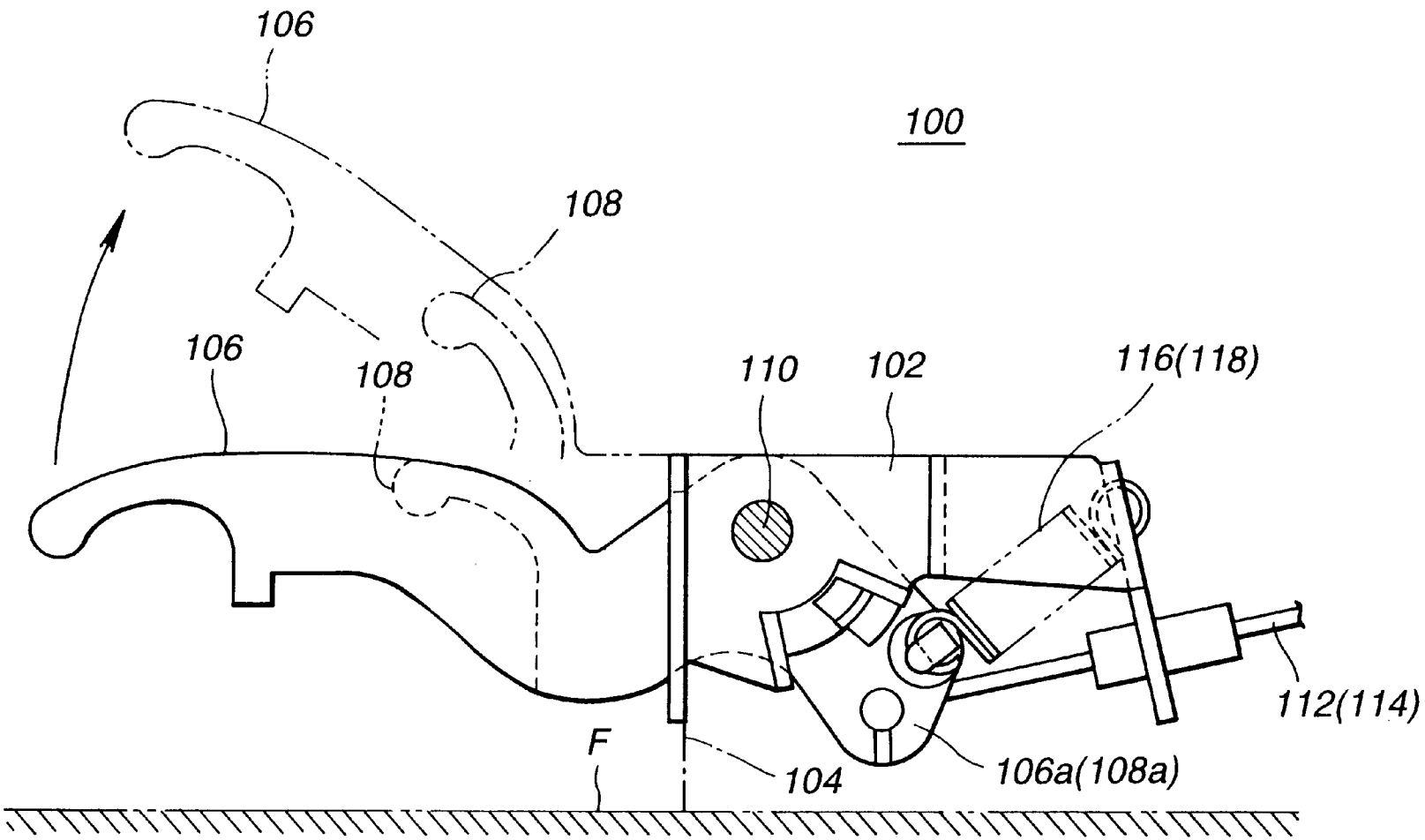
FIG.10 (PRIOR ART)
FIG. 10 is a front view of a conventional double lever type lid opener.
Figure 11:
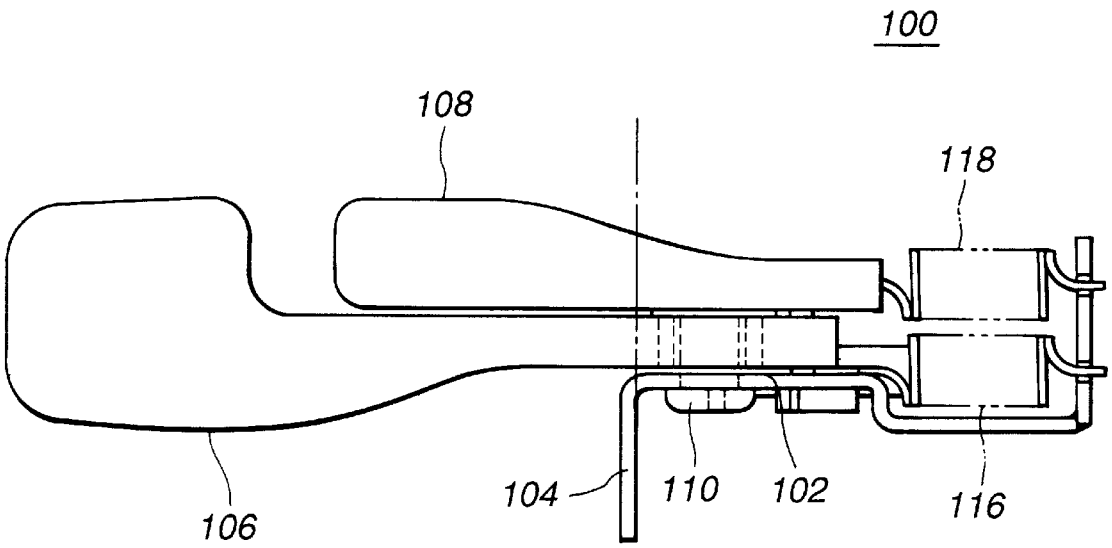
FIG.11 (PRIOR ART)
FIG. 11 is a plan view of the conventional double lever type lid opener.

As is seen from FIGS. 6 and 8, like in the first embodiment 10A, the lid opener 100B of this second embodiment comprises longer and shorter control levers 20' and 22' which are pivotally disposed about a common pivot shaft 28. Each control lever 20' or 22' has at the front exposed part a convexly curved upper edge. The pivot shaft 28 is held by a base member 24' which is constructed of a metal. The base member 24' comprises a front flat part 24'*a* secured to the cross member 10, a middle flat part 24'*b* extending rearward from the front flat part 24'*a,* an upper cover part 24'*c* extending laterally from an upper end of the middle flat part 24'*b* and an inclined rear part 24'*d*. The middle flat part 24'*b* is formed at its lower portion with a stopper projection 24'*e* which extends toward the shorter control lever 22'. The shape of the stopper projection 24'*e* may be seen from FIG. 9.

As is seen from FIG. 6, the longer control lever 20' has near the wire connector 20'*c* a forward projection 36 which abuts against the stopper projection 24'*e* when the lever 20' is pivoted up to the upper work position. A biasing spring 30 extends between a rear end 20'*b* of the longer control lever 20' and the middle flat part 24'*b*. From a wire connector 20'*c* provided by the rear end 20'*b,* there extends a wire 32 to a latch mechanism of a trunk lid. A guide member 34 is pivotally held by the inclined rear part 24'*d* of the base member 24', through which the wire 32 extends. Due to the force of the biasing spring 30, the longer control lever 20' is biased to assume the horizontal rest position. The shorter control lever 22' has substantially the same construction as the longer control lever 20' except that in the shorter control lever 22', a wire connected to the rear end of the lever 22' extends to a latch mechanism of a filler cap.

In the second embodiment 100B, the following measures are further employed.

That is, as is seen from FIG. 6, the longer control lever 20' is formed at a rear portion thereof with a rear stopper portion 20'B which is contactable with the upper cover part 24'*c* of the base member 24'.

Figure 7:
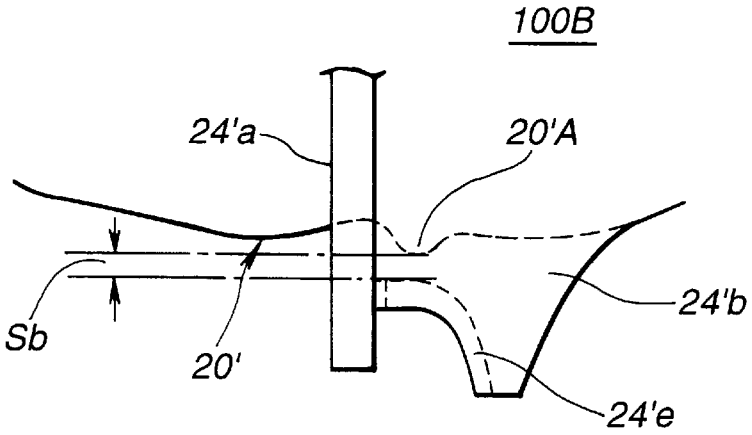
FIG. 7 is art enlarged view of the portion indicated by an arrow "VII" in FIG. 6.

Furthermore, as is seen from FIGS. 6 and 7, the longer control lever 20' is formed near the pivot shaft 28 with a middle stopper portion 20'A which projects downward. When the longer control lever 20' assumes the horizontal rest position as shown in FIGS. 6 and 7, the rear stopper portion 20B abuts against the upper cover part 24'*c* of the base member 24' leaving a predetermined space "Sb" between the middle stopper portion 20'A and the stopper projection 24'*e*. The thickness of the space "Sb" is determined smaller than a moved distance which is exhibited by the middle stopper portion 20'A when the latter is subjected to a maximum resilient deformation, that is, when the lever 20' is strongly stepped by a passenger (viz., driver). Preferably, the thickness of the space "Sb" is smaller about 1 mm.

It is to be noted that the above-mentioned measures of the longer control lever 20' are not needed by the shorter control lever 22'. However, if desired, such measures may be applied to the shorter one.

When, with the lid opener 100B assuming a rest condition as shown in FIG. 6, the longer control lever 20 is pulled up against the force of the spring 30, the wire 32 is driven in a direction to cancel the latched condition of the trunk lid. Due to provision of the stopper projection 24'*e* against which the forward projection 36 of the lever 20' can abut, the upper position of the longer control lever 20' is assured. When the longer control lever 20' is released, the lever 20' is returned to the horizontal rest position of FIG. 6 due to the force of the spring 30. When the shorter control lever 22' is pulled up, the latched condition of the filler cap becomes canceled and thus the filler cap can be opened, like in the case of the above-mentioned trunk lid.

When, with the lid opener 100B assuming the rest condition, a remarkable force is suddenly applied to the exposed front portions of the longer and shorter control levers 20' and 22' due to accidental stepping by a driver's shoe, the longer control lever 20' is pressed down bringing the middle stopper portion 20'A thereof into abutment with the stopper projection 24'*e* of the base member 24' while keeping the abutment of the rear stopper portion 20'B with the upper cover part 24'*c* of base member 24'. During this, the longer control lever 20' is subjected to a resilient deformation by a degree of the thickness of the space "Sb", and upon abutment of the middle stopper portion 20'A with the stopper projection 24'*e*, the force applied to the longer control lever 20' becomes supported by three supporting points, which are a first supporting point "P'1" where the middle stopper portion 20'A" contacts the stopper projection 24'*e* of the base member 24', a second supporting point "P'2" where the rear stopper portion 20'B contacts the upper cover part 24'*c* of the base member 24' and a third supporting point "P'3" where the longer control lever 20' is disposed about the pivot shaft 28. That is, like in the case of the above-mentioned first embodiment 100A, the shock applied to the longer control lever 20' is supported by the three points minimizing the force actually applied to each supporting point "P'1", "P'2" or "P'3". Thus, undesired deformation and damage of the longer control lever 20' are suppressed.

It is to be noted that even when both the longer and shorter control levers 20' and 22' are stepped by the driver's shoe, the longer control lever 20' protects the shorter control lever 22' by carrying out the above-mentioned self-supporting function.

The entire contents of Japanese Patent Application P10-87235 (filed Mar. 31, 1998) are incorporated herein by reference.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A lid opener for use in a vehicle having a body and a floor, comprising:

a base member adapted to be secured to said body;

a control lever pivotally supported on said base member through a pivot shaft, said control lever including front and rear portions which are respectively distal and proximate with respect to a pivoted end portion thereof, said rear portion being adapted to connect through a power transmitting member to a latch mechanism of a lid member, said control lever being capable of canceling a latched condition of said latch mechanism when pivoted in a first direction from a rest position to a latch release position;

biasing means for biasing said control lever in a second direction toward said rest position, said second direction being opposite to said first direction;

a first stopper structure including said rear portion of said control lever and a part of said base member, said rear portion contacting said part of the base member in a manner to prevent pivoting of the control lever in said second direction when said control lever assumes said rest position; and a second stopper structure including an engagement part of said control lever and a normally spaced stopper member which is defined by either one of the vehicle floor and said base member, the engagement part of said control lever being brought into abutment with said stopper member thereby suppressing deformation of the control lever in said second direction when said control lever is in said rest position and a marked stress is applied to the front portion thereof, and wherein, when said control lever is applied with the marked stress at the front portion thereof and said control lever is resiliently deformed beyond said rest position in the second direction, said control lever assumes a supported position wherein it is supported by three supporting points comprising:

a first point where the rear portion of the control lever contacts the part of said base member, a second point where the engagement part of the control lever contacts the stopper member, and a third point where the control lever is supported by said pivot shaft.

2. A lid opener as claimed in claim 1, in which said engagement part of said control lever is normally spaced from said stopper member by a predetermined distance when said control lever assumes said rest position and is undistorted by the application of a marked stress.

3. A lid opener as claimed in claim 2, in which said predetermined distance is a distance traveled by the engagement part of said control lever when said control lever is subjected to the application of the marked stress at the front portion of said control lever and said control lever is changed from an undeformed state to one wherein a maximum resilient deformation has occurred and wherein the engagement part of the control lever is forced into engagement with the stopper member which is defined by either one of the vehicle floor and said base member.

4. A lid opener as claimed in claim 3, in which said engagement part of said control lever is defined at said front portion of said control lever and in which said stopper member is the vehicle floor.

5. A lid opener as claimed in claim 4, in which said predetermined distance is smaller than about 5 mm.

6. A lid opener as claimed in claim 3, in which said engagement part of said control lever is defined near the pivoted end portion of the control lever and in which said stopper member is a stopper structure defined by said base member.

7. A lid opener as claimed in claim 1, further comprising a third stopper structure which includes another part of said base member and a given part of said rear portion of said control lever, said given part being brought into abutment with said another part of said base member when said control lever is pivoted in the normal direction from said rest position to the work position.

8. A lid opener as claimed in claim 7, in which said given part of said rear portion of the control lever constitutes a connector to which one end of said power transmitting member is connected.

9. A lid opener as claimed in claim 7, in which said given part of said rear portion of the control lever is projected downward.

10. A lid opener as claimed in claim 1, further comprising another control lever which is pivotally supported on said base member by the pivot shaft on which the first said control lever is pivotally supported, said another control lever having a rear portion connected through another power transmitting member to a latch mechanism of another lid member.

11. A lid opener as claimed in claim 10, in which said another control lever is received in a recess formed in the the first said control lever.

12. In a vehicle having a hollow cross member mounted on a vehicle floor, said hollow cross member having an opening in a wall portion thereof, a lid opener unit comprising:

a base member installed in and secured to said hollow cross member near said opening;

a control lever pivotally connected to said base member, said control lever including front and rear portions which are respectively distal and proximate with respect to a pivoted end portion thereof, said front portion extending out through said opening so as to extend over the floor, said rear portion being connected through a power transmitting member to a latch mechanism of a lid member, said control lever canceling a latched condition of said latch mechanism when pivoted in a first direction from a rest position to a latch release position;

biasing means for biasing said control lever in a direction to assume said rest position;

a first stopper structure including said rear portion of said control lever and a stopper part of said base member, said rear portion contacting said stopper part of the base member when said control lever assumes said rest position to prevent pivotal movement of said control lever in a second direction which is opposite the first direction; and a second stopper structure including an engaging part of said control lever and a normally spaced stopper member which is defined by either one of the vehicle floor and said base member, the engaging part of said control lever being brought into abutment with said stopper member only when said control lever is resiliently distorted from the rest position in the second direction by the application of a marked stress which is applied to said front portion.

* * * * *